United States Patent [19]

Yabata

[11] 4,268,895

[45] May 19, 1981

[54] AUTOMOTIVE HEADLIGHT

[75] Inventor: Hisao Yabata, Takasaki, Japan

[73] Assignee: Ichikawa Press Industries Co., Ltd., Takasaki, Japan

[21] Appl. No.: 931,099

[22] Filed: Aug. 4, 1978

[30] Foreign Application Priority Data

Dec. 29, 1977 [JP] Japan ..... 52/176567[U]

[51] Int. Cl.[3] ..... F21V 7/00

[52] U.S. Cl. ..... 362/307; 362/341

[58] Field of Search ..... 362/307, 296, 341

[56] References Cited

U.S. PATENT DOCUMENTS

| | | | |
|---|---|---|---|
| 1,446,925 | 2/1923 | Olney | 362/307 |
| 1,637,895 | 8/1927 | Cullinan | 362/307 |
| 1,722,310 | 7/1929 | Roche | 362/307 |
| 1,805,690 | 5/1931 | Dodge | 362/307 |
| 1,843,577 | 2/1932 | McElroy | 362/307 |
| 2,204,429 | 6/1940 | Montague | 362/307 |
| 3,553,519 | 1/1971 | Hicks | 362/307 |

FOREIGN PATENT DOCUMENTS

| | | | |
|---|---|---|---|
| 1149920 | 4/1969 | United Kingdom | 362/307 |
| 1208110 | 10/1970 | United Kingdom | 362/307 |
| 1221946 | 2/1971 | United Kingdom | 362/307 |

*Primary Examiner*—Monroe H. Hayes

*Attorney, Agent, or Firm*—Blanchard, Flynn, Thiel, Boutell & Tanis

[57] ABSTRACT

An automotive headlight having a hood to shade harmful beams of light as far as possible, in which a lamp bulb is provided at the focus of the reflector and a diffuser lens is provided in front of the reflector. The hood is provided in such a manner that the light which is emitted from the filament and passes by the base of the glass tube constituting the lamp bulb is shaded. In the first example, the harmful light which has passed by the base of the glass tube is shaded by the extension of the hood leg before it reaches the reflector. In the second example, the light is shaded by the front of the hood after reflection by the reflector.

6 Claims, 12 Drawing Figures

AUTOMOTIVE HEADLIGHT

BACKGROUND OF THE INVENTION

The present invention relates to automotive lights such as headlights, fog lights, and running lights. More particularly, this invention relates to an automotive headlight in which the light which is emitted from the filament and passes by the base of the glass tube constituting the lamp bulb is shaded as far as possible in order to eliminate harmful light which is caused by upward diffusion during driving.

An automotive light should have a sufficient intensity of illumination so that any obstacle on the road ahead can be confirmed. On the other hand, an automotive light should not illuminate the opposite lane and emit upward light in order to protect the driver on a car running in the opposite direction from dazzlement. These requirements can be met for the most part by properly designing the front diffuser lens and by adjusting the angle of direction of the illuminating lamp.

It has been found that there is still a cause of problems that cannot be solved by these methods, and it consists in the structure of the lamp bulb. This will be described below.

There is one type of lamp bulb designed for improved efficiency in which the glass tube is made small, the tube is filled with a halogen gas, and radiation is accomplished at a high temperature.

In FIG. 1, plan view with a partial cutaway view, and FIG. 2, side view with a partial cutaway view, the lamp bulb (1) consists of the glass tube (2) and the filament (3) provided therein, and the base (4) of the glass tube (2) is held by the glass tube holder cylinder (5). The lamp bulb (1) is mounted at the central opening (8) of the reflector (7) through the bulb spacer (8).

This type of lamp bulb (1) has a disadvantage that it is very difficult to make the curves (9) and (10) of the base of the glass tube (2) uniform in thickness in the bulb production process. The curves (9) and (10) get thicker near the base (4), forming a prism-like structure. The range of effective luminous flux emitted from the filament (3) is usually about 290 degrees as shown in FIG. 2, and the curves (9) and (10) of the glass tube (2) are covered by this range. Thus, at these curves (9) and (10), the light from the filament (3) is deflected by the prism action. In other words, the beam of light which is supposed to pass along the chain line is deflected at the curves (9) and (10) as indicated by the solid line. This creates a condition in which the filament (3) emits light as if it had emitted light at the position (3') on the chain line, and this means that the filament is placed out of the focus. Consequently, the light which has passed through the curves (9) and (10) and has been reflected by the reflector (7) is not made parallel. The hatched parts (A) and (B) on the reflector (7) as shown in FIG. 3, which are near the center of the reflector (7) and a little lower than the horizontal line passing through the center, reflects the light upward, causing dazzlement to the driver on a car running in the opposite direction. The upward light undergoes diffused reflection in the rain, resulting in a light screen phenomenon that deteriorates driver's visibility.

BRIEF SUMMARY OF THE INVENTION

It is the object of this invention to provide an automotive headlight having a hood that shades the light of the filament passing by the base of the glass tube of the lamp bulb in order to absorb or diffuse the above-mentioned harmful light.

In one embodiment, the hood is provided near the central opening of the reflector where the lamp bulb is mounted, in such a manner that the legs of the hood are extended from the vicinity of the central opening. Each leg has an expanded part that shades the harmful light before it reaches the reflector.

In another embodiment, the hood is supported on the legs provided at the lower part of the reflector, and the harmful light is shaded by the front part of the shade after reflection by the reflector.

The hood should preferably be coated in black for absorption of light.

As will be apparent from the foregoing, it is an object of this invention to provide an automotive headlight that shades the harmful light passing by the base of the glass tube of the lamp bulb in order to protect the driver in a car running in the opposite direction from dazzlement and in order to prevent the visibility from being deteriorated by a light screen phenomenon.

It is another object of this invention to provide an inexpensive automotive headlight of simple structure.

Other objects and advantages of this invention will become readily apparent from the following description and accompanying drawing.

DETAILED DESCRIPTION OF THE INVENTION

Two preferable examples of this invention are described referring to the accompanying drawings.

Figure 1:
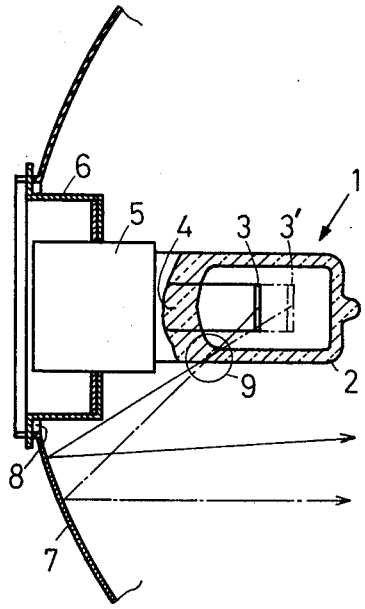
FIG. 1 is a partially cutaway plan view of a conventional automotive headlight.
Figure 2:
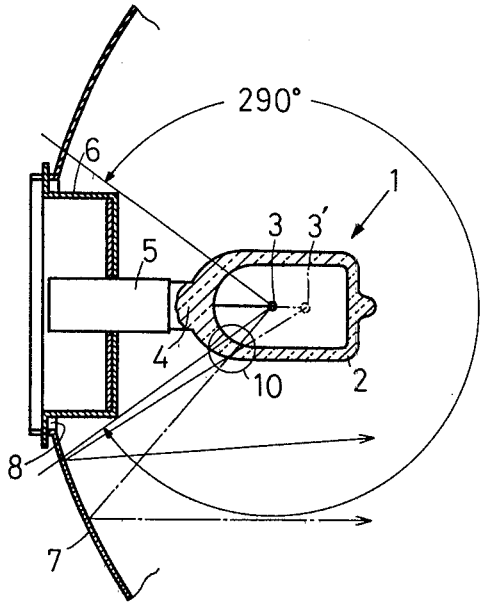
FIG. 2 is a partially cutaway side view of the same conventional automotive headlight as above.
Figure 3:
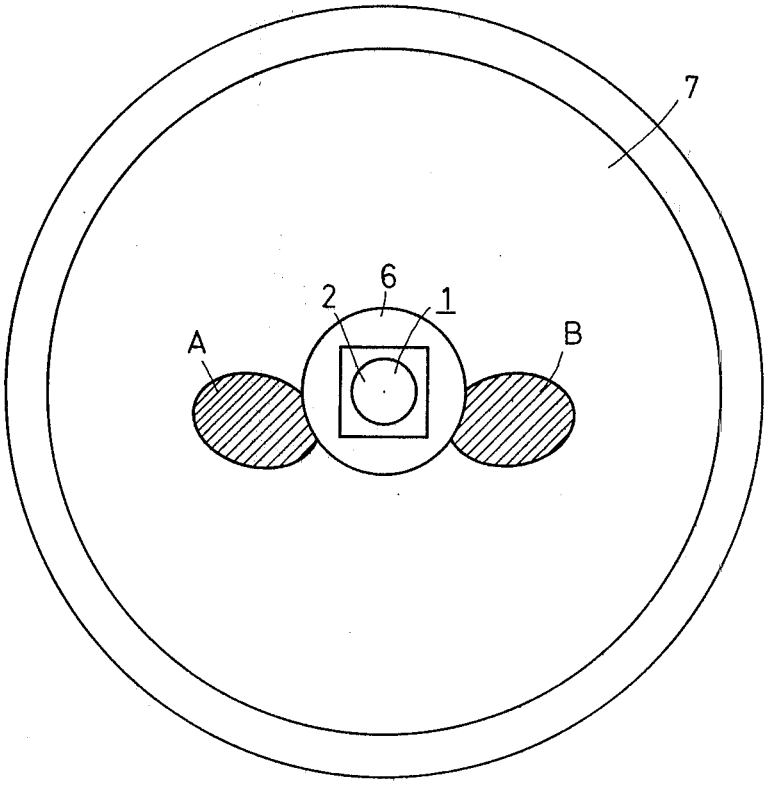
FIG. 3 is a front view of the same conventional automotive headlight as above, with the diffuser lens removed.

FIGS. 4 to 7 illustrate the first example of this invention. In this example, the reflector (7) is circular as viewed from front, and the legs (13) of the hood (11) extend from the vicinity of the central opening where the lamp bulb (1) is mounted. The reflector (7) is formed into a paraboloid of revolution by pressing a metal sheet, and the inside of the reflector is finished for reflection. At the front of the reflector is provided a diffuser lens (not shown) by bonding or crimping, and at the vertex is provided the opening (8). To the opening (8) is provided the lamp bulb (1) through the bulb spacer (6) in the normal manner as shown in FIGS. 1 and 2.

In this construction, the hood (11) is provided at the vicinity of the above-mentioned opening (8). This hood is formed by pressing a metal sheet. The hood encloses approximately the forward half of the glass tube (2), and consists of the shading part (12) of quadrangular prism that opens at the reflector side (7) and the legs (13) and (13) that extend from both sides of the shading part (12). The shading part (12) is provided with the window (14), covering the lower half of the front to the bottom, through which the downward light passes to illuminate the road surface. At the lower side of the leg (13) is provided an integral, triangular expanded part (15) that shades harmful light (A)(B) before it reaches the reflector (7). Also, at the end of the leg is integrally provided the fitting metal (16) to fix the leg (13) to the reflector (7). The hood (11) of this shape is coated in black with heat-resistant paint in order to eliminate light reflection.

FIGS. 8 to 12 illustrate the second example of this invention. In this example, the reflector (7) is of rectangular shape, with the upper and lower parts (17) cut off. The hood (11) is provided on one of the horizontal parts (17). The lamp bulb (1) is mounted to the central opening (8) of the reflector (7) through the bulb spacer (6) in the normal manner. At the front of the reflector (11) is provided a lens (not shown).

Figure 4:
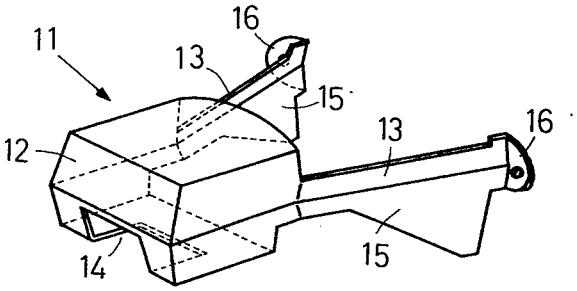
FIG. 4 is a perspective view of the hood in the first example.
Figure 5:
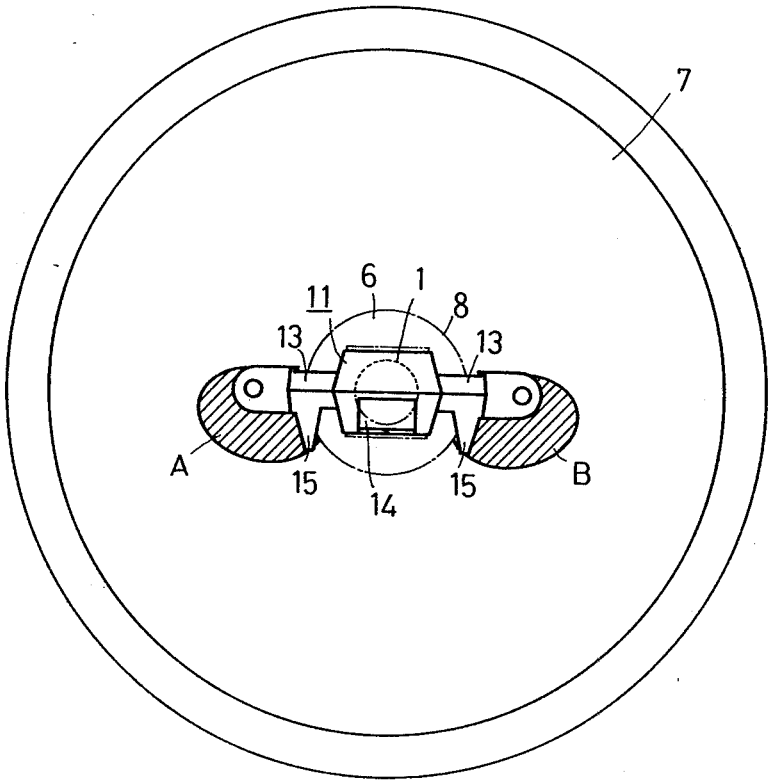
FIG. 5 is a front view of the same hood as above attached to the reflector.
Figure 6:
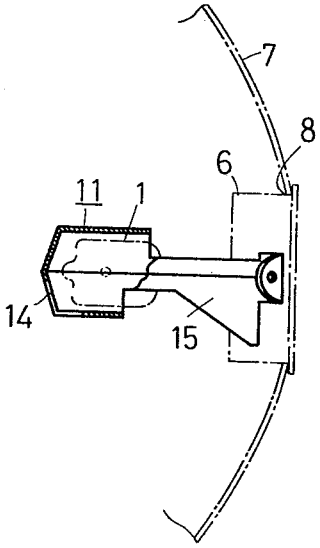
FIG. 6 is a partially cutaway side view of the same hood and reflector as above.
Figure 7:
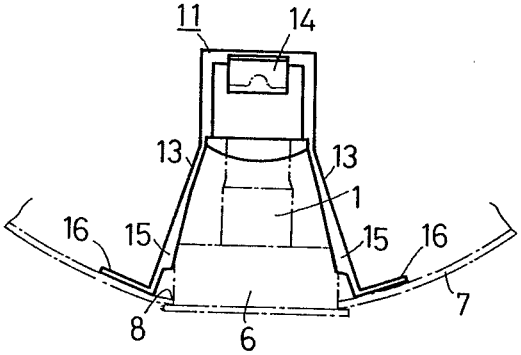
FIG. 7 is a bottom view of the same hood as above.
Figure 8:
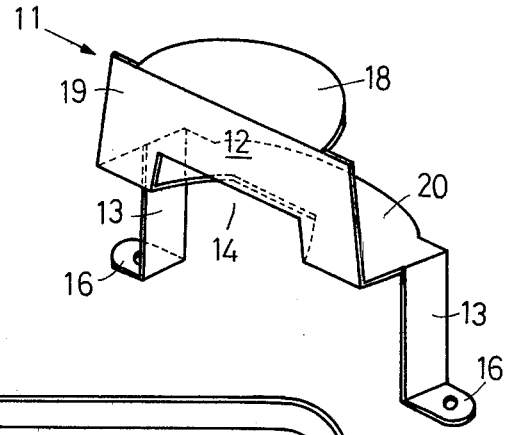
FIG. 8 is a perspective view of the hood of the second example.
Figure 9:
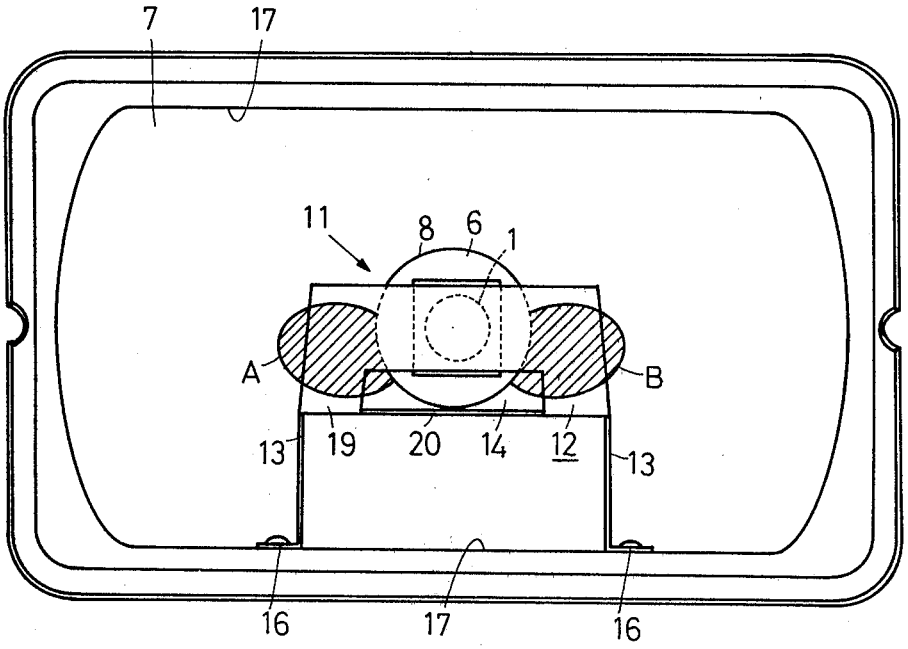
FIG. 9 is a front view of the same hood as above attached to the reflector.
Figure 10:
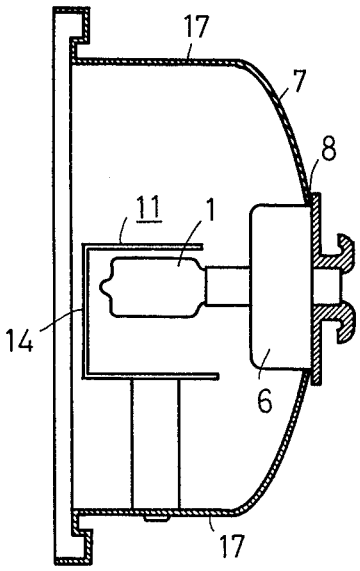
FIG. 10 is a side view of the same hood as above attached to the reflector.
Figure 11:
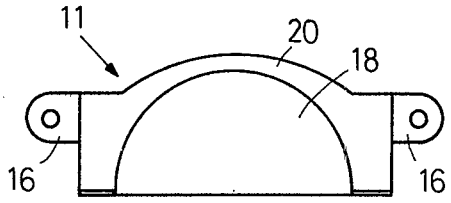
FIG. 11 is a plan view of the same hood as above.
Figure 12:
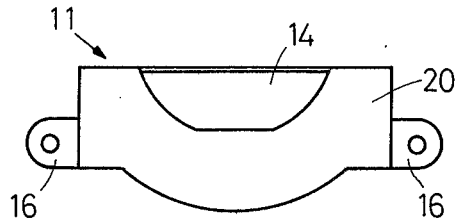
FIG. 12 is a bottom view of the same hood as above.

In this construction, the hood (11) is provided on the horizontal part (17) of the reflector (7). This hood (11) is formed by pressing a metal sheet and coated in black with heat-resistant paint in order to eliminate light reflection. This hood (11) consists of the shading part (12) and the legs (13) and (13). The shading part (12) is a C-shaped element consisting of the top (18), front (19), and bottom (20). The leg (13) is provided with the fitting metal (16) to fix the leg (13) to the reflector (7). The shading part (12) is provided with the window (14), covering the lower half of the front to the bottom, through which the downward light passes to illuminate the road surface. The front (19) of the shading part (12) is wider than that of the hood (11) as shown in FIG. 4. As shown in FIG. 9, the harmful light (A) (B) reflected by the reflector (7) is shaded by both sides of the front (19) of the hood (11).

What is claimed is:

1. An improved automotive headlight of the type having:

a front lens and a rear reflector enclosing a headlight cavity therebetween;

a lamp bulb disposed near the center of the reflector within said headlight cavity, said lamp bulb being of the type having ray refracting base wall portions adjacent its rear end, such that light rays passing through said ray refracting portions of said lamp bulb have paths from said bulb back to said reflector and forwardly out through said lens;

a hood disposed in said cavity and having means supporting said hood on said reflector, said hood having side walls disposed on opposite sides of said lamp bulb and a top wall overlying a substantial portion of said lamp bulb and a bottom wall underlying said lamp bulb and a front wall disposed in front of said lamp bulb and joining said top and bottom walls of said hood, said hood defining a rear opening box receiving said lamp bulb;

wherein the improvement comprises:

said hood including light blocking wings which extend horizontally beyond said lamp bulb into said refracted ray path to block at least a part of said refracted rays, said wings being spaced laterally outboard of said lamp bulb and extending rearwardly behind and on opposite sides of said lamp bulb, said wings angling divergently rearwardly from said side walls of said box, said wings each comprising a rearwardly extending leg terminating in a foot fixed to said reflector on opposite sides of the axis of said lamp bulb and defining said means supporting said hood on said reflector, and wings each further comprising a substantially triangular extension depending from said leg into said refracted ray path to block said refracted rays before they reach said reflector, said light blocking wings being free of connection to said lamp bulb except through said reflector.

2. The apparatus of claim 1, in which said lamp bulb includes a light source therein, the refracting base wall portions of said lamp bulb bending the rays from said light source toward said reflector along the same path as nonrefracted rays emanating from an imaginary light source spaced forwardly from said light source in said lamp bulb, such that ones of said refracted rays striking said reflector in areas on opposite sides of said lamp bulb and centered somewhat below the axis thereof tend to have a path of reflection angled upward from said reflector through said lens, said light blocking wings being spaced from said lamp bulb and lying across the portion of said refracted light ray paths centered in said areas, said light blocking wings being angled with respect to each other to converge downwardly.

3. An improved automotive headlight of the type having:

a front lens and a rear reflector enclosing a headlight cavity therebetween;

a lamp bulb disposed near the center of the reflector within said headlight cavity, said lamp bulb being of the type having ray refracting base wall portions adjacent its rear end, such that light rays passing through said ray refracting portions of said lamp bulb have paths from said bulb back to said reflector and forwardly out through said lens;

a hood disposed in said cavity and having means supporting said hood on said reflector, said hood having a top wall overlying a substantial portion of said lamp bulb and a bottom wall underlying said lamp bulb and a front wall disposed in front of said lamp bulb and joining said top and bottom walls of said hood;

wherein the improvement comprises:

said hood front wall having light blocking wings which extend horizontally beyond said lamp bulb into the portion of the path of said refracted rays between said rear reflector and front lens to block at least a part of said refracted rays after reflection from said rear reflector, said front wall being continued in a substantially coplanar manner into said wings, said wings extending sidewardly at least beyond said top wall and sufficiently to at least substantially overlap the portions of said reflector in said path of said refracted rays emanating from said refracting portions adjacent the rearward end of said lamp bulb, said lamp bulb including a light source therein, the refracting base wall portions of said lamp bulb bending the rays from said light source toward said reflector along the same path as nonrefracted rays emanating from an imaginary light source spaced forwardly from said light source in said lamp bulb, such that ones of said refracted rays striking said reflector in areas adjacent and on opposite sides of said lamp bulb and centered somewhat below the axis thereof tend to have paths of reflection converging upward and laterally inward toward the headlight axis from said reflector through said lens, said light blocking wings being spaced from said lamp bulb and lying across the portion of said refracted light ray paths centered in said areas, said light blocking wings being free of connection to said lamp bulb except through said reflector.

4. The apparatus of claim 3, in which said hood supporting means comprises legs extending from the side edges of said bottom wall to the adjacent wall of said reflector.

5. The apparatus of claim 1 or 3, in which said hood has a common window extending into adjoining portions of said front and bottom walls of said hood below the central axis of said bulb and in front of said bulb for passing light directly from said bulb forwardly and downwardly through said lens, said wings extending horizontally beyond said window and said front wall.

6. The apparatus of claim 1 or 3, wherein said hood is treated for nonreflection by coating in black.

* * * * *